US007626340B2

(12) United States Patent
Kang et al.

(10) Patent No.: US 7,626,340 B2
(45) Date of Patent: Dec. 1, 2009

(54) DISPLAY APPARATUS AND CONTROL METHOD THEREOF

(75) Inventors: Jeong-il Kang, Yongin-si (KR); Sang-hoon Lee, Ulsan (KR); Kyoung-geun Lee, Suwon-si (KR); Yung-jun Park, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 277 days.

(21) Appl. No.: 11/442,389

(22) Filed: May 30, 2006

(65) Prior Publication Data

US 2006/0290298 A1 Dec. 28, 2006

(30) Foreign Application Priority Data

Jun. 22, 2005 (KR) ..... 10-2005-0054117

(51) Int. Cl.
*H05B 37/00* (2006.01)

(52) U.S. Cl. ..... 315/209 R; 315/169.3; 315/307

(58) Field of Classification Search ..... 315/291, 315/209 R, 307, 169.3
See application file for complete search history.

(56) References Cited

U.S. PATENT DOCUMENTS 6,320,330 B1 11/2001 Haavisto et al.
2006/0022607 A1* 2/2006 Hsu ..... 315/209 R

FOREIGN PATENT DOCUMENTS

| | | |
|---|---|---|
| JP | 09-021998 | 1/1997 |
| JP | 11-109919 | 4/1999 |
| JP | 2003151784 | 5/2003 |
| KR | 1020030096701 A | 12/2003 |
| KR | 1020040101654 A | 12/2004 |

* cited by examiner

*Primary Examiner*—David Hung Vu
(74) *Attorney, Agent, or Firm*—Roylance, Abrams, Berdo & Goodman, L.L.P.

(57) ABSTRACT

The present invention relates to a display apparatus comprising a light emitting element supplying light, and a switch to switch on and off power, which is supplied to the light emitting element. A comparing unit compares a predetermined first reference voltage and an output voltage which is proportional to a current applied to the light emitting element. A controller compares a comparison voltage output, which is a comparison result of the comparing unit and a predetermined second reference voltage, in order to control the switch to be switched on and off. Accordingly, the present invention provides a display apparatus and control method which precisely controls a size of a current applied to a light emitting element.

8 Claims, 4 Drawing Sheets

DISPLAY APPARATUS AND CONTROL METHOD THEREOF

CROSS-REFERENCE TO RELATED APPLICATIONS

This application claims the benefit under 35 U.S.C. § 119(a) of Korean Patent Application No. 2005-0054117, filed on Jun. 22, 2005, in the Korean Intellectual Property Office, the entire disclosure of which is hereby incorporated by reference.

BACKGROUND OF THE INVENTION

1. Field of the Invention

The present invention relates to a display apparatus and a control method thereof. More particularly, the present invention relates to a display apparatus and control method, which precisely controls the amount of current applied to a predetermined light emitting element.

2. Description of the Related Art

Generally, a display apparatuses include cathode ray tubes (CRT) and a flat panel displays (FPD) The flat panel display usually employs a liquid crystal display (LCD) panel or a plasma display panel (PDP) to display an image. However, new types of display apparatuses, such as organic light emitting diode (OLED) and digital light processing (DLP), are being developed.

The display apparatus, such as, the LCD or the DLP employs a light emitting element, such as a light emitting diode (LED), as a light source of a backlight unit. The LED is a point light source and provides high brightness and excellent color realization.

As shown in FIG. 4, a conventional display apparatus controls a current applied to the LED through a pulse width modulation (PWM) generator. The PWM generator compares a voltage Vout, which is proportional to a size of the current output to the LED, to a predetermined reference voltage Vr2, to control a current supply.

Voltages applied to the PWM generator pass through a predetermined processing before being directly applied to a comparator 310, which is disposed in the PWM generator. That is, the voltages applied to the comparator 310 in the PWM generator receive a predetermined gain or an offset. If the processing is not precisely carried out, the voltages applied to the comparator 310 in the PWM generator become different in size, thereby causing errors in an output current.

Accordingly, there is a need for an improved display apparatus and control method thereof, that controls the amount of current supplied to a light emitting element.

SUMMARY OF THE INVENTION

An aspect of exemplary embodiments of the present invention is to address at least the above problems and/or disadvantages and to provide at least the advantages described below. Accordingly, an aspect of embodiments of the present invention is to provide a display apparatus and a control method thereof, which precisely controls an amount of a current applied to a light emitting element.

Additional aspects and/or advantages of exemplary embodiments of the present invention will be set forth in part in the description which follows and, in part, will be obvious from the description, or may be learned by practice of the present invention.

The foregoing and/or other aspects of exemplary embodiments of the present invention are also achieved by providing a display apparatus comprising a light emitting element for supplying light and a switch to switch on and off power, which is supplied to the light emitting element. A comparing unit compares a predetermined first reference voltage to an output voltage, which is proportional to current applied to the light emitting element. A controller compares an output comparison voltage from a comparison result of the comparing unit and a predetermined second reference voltage, so as to control the switch to be switched on and off.

According to an aspect of exemplary embodiments of the present invention, the controller comprises a pulse width modulation (PWM) generator for generating a PWM signal to control the switch.

According to another aspect of exemplary embodiments of the present invention, the controller compares the comparison voltage output from the comparison result of the comparing unit to the predetermined second reference voltage, and turns off the switch if the comparison voltage is larger than the predetermined second reference voltage.

According to still another aspect of exemplary embodiments of the present invention, the light emitting element is powered by a switching method in which the current supplied to the light emitting element increases when the switch is turned on and the current supplied to the light emitting element decreases when the switch is turned off.

The foregoing and/or other aspects of exemplary embodiments of the present invention are also achieved by providing a method of controlling a display apparatus having a light emitting element supplying light, the method comprising comparing a predetermined first reference voltage to an output voltage which is proportional to a current applied to the light emitting element. A comparison voltage is outputted according to a comparison result. The comparison voltage is compared to a predetermined second reference voltage. Power supplied to the light emitting element is switched on and off according to the comparison result.

According to another aspect of exemplary embodiments of the present invention, the comparing of the comparison voltage to the predetermined second reference voltage comprises outputting a PWM signal to control a switch to be turned on and off according to the comparison result.

According to still another aspect of the present invention, the switching comprises cutting off power supplied to the light emitting element if the comparison voltage is larger than the second reference voltage.

According to yet another aspect of exemplary embodiments the present invention, the switching comprises increasing the current supplied to the light emitting element if power is supplied, and decreasing the current supplied to the light emitting element if power is cut off.

Other objects, advantages, and salient features of the invention will become apparent to those skilled in the art from the following detailed description, which taken in conjunction with the annexed drawings, discloses exemplary embodiments of the invention.

BRIEF DESCRIPTION OF THE DRAWINGS

The above and other objects, features, and advantages of certain exemplary embodiments of the present invention will be more apparent from the following description, taken in conjunction with the accompanying drawings in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
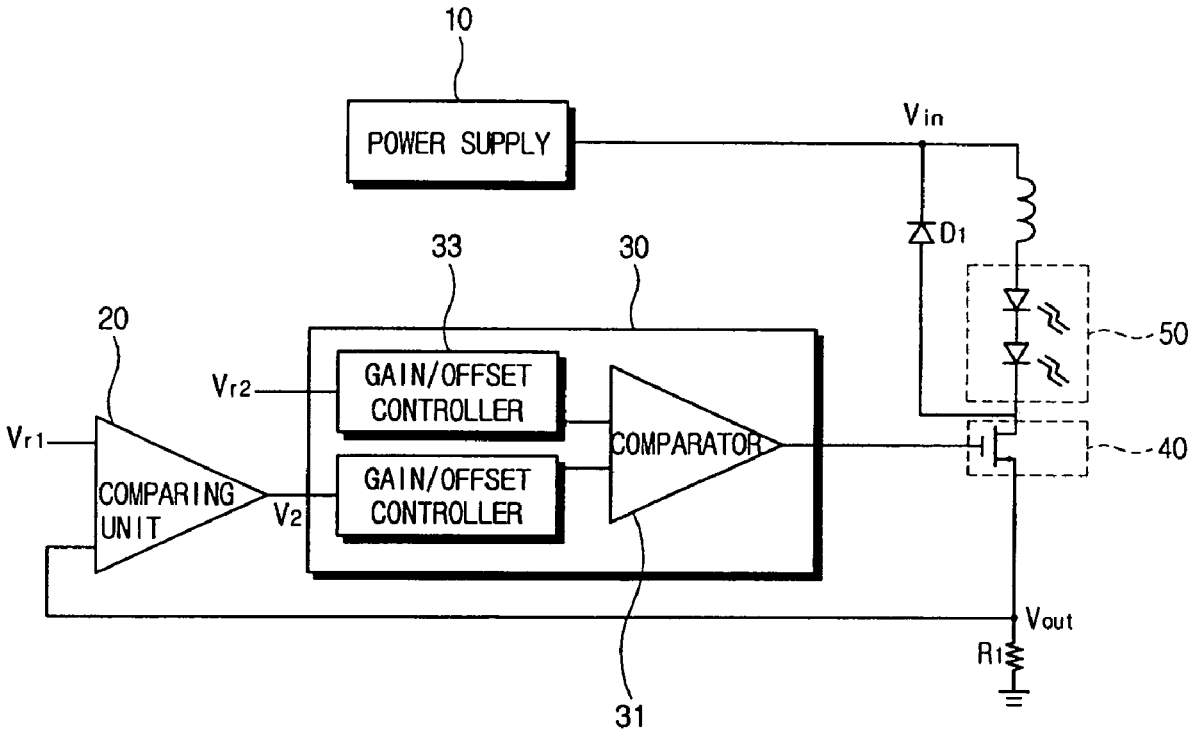
FIG. 1 is a control block diagram of a display apparatus according to an exemplary embodiment of the present invention.

As shown in FIG. 1, a display apparatus according to an exemplary embodiment of the present invention comprises light emitting elements 50; a comparing unit 20; a switch 40 for switching on and off power supplied to the light emitting elements 50; and a controller 30 to control the switch 40 to switch on and off.

The light emitting elements 50 preferably comprise a light emitting diode (LED). The LED may comprise a RLED to emit a red light, GLED to emit a green light, and BLED to emit a blue light.

A power supply 10 supplies power to an electrode of the respective light emitting elements 50. Luminance of the light emitting elements 50 is adjusted according to the amount of current of power supplied from the power supply 10. Accordingly, the light emitting elements 50 provide light to display an image on the display apparatus.

The comparing unit 20 compares a predetermined first reference voltage Vr1 to an output voltage Vout, which is proportional to the current supplied to the light emitting elements 50. Accordingly, the size of the current is detected to adjust luminance of the light emitting elements 50. In this instance, the current is proportional to the voltage by formula V=IR. Consequently, the voltage supplied to a resistor RI may be detected in order to detect the current supplied to the light emitting elements 50. The comparing unit 20 compares the output voltage Vout supplied to the resistor R1 to the predetermined first reference voltage Vr1. The comparing unit 20 is preferably provided as a comparator, but not limited thereto. Alternatively, various comparing units 20 may be provided as long as it functions as a comparator.

The controller 30 controls the switch 40 to switch on and off based on a comparison result output from the comparing unit 20. Here, the controller 30 may comprise a pulse width modulation (PWM) generator which generates a PWM signal to control the switch 40.

If the controller 30 comprises the PWM generator, the controller 30 compares a comparison voltage V2 output from the comparing unit 20 to a predetermined second reference voltage Vr2, and generates the PWM signal accordingly.

At this time, the current supplied to the light emitting elements 50 is adjusted by changing the first reference voltage Vr1. The second reference voltage Vr2 is preferably set as a predetermined voltage lower than the output voltage of the comparing unit 20. The second reference voltage Vr2 may be changed as necessary, but is adjusted to not affect the output current.

For example, if a comparator 31 is provided in the PWM generator, a minus (−) terminal of the comparator 31 receives a voltage value in which the second reference voltage Vr2 is processed by the gain or the offset. A plus (+) terminal of the comparator 31 receives a voltage value in which an output comparison voltage V2 from the comparing unit 20 is processed by the gain or the offset. If the processed value of the comparison voltage V2 is larger than the processed value of the second reference voltage Vr2, the PWM generator outputs '1' as the PWM signal. If the processed value of the comparison voltage V2 is smaller than the processed value of the second reference voltage Vr2, the PWM generator outputs '0' as the PWM signal.

The switch 40 switches on and off power supplied from the power supply 10. Here, the switch 40 is preferably provided as a metal-oxide semiconductor field effect transistor (MOSFET), but is not limited thereto. Alternatively, the switch 40 may be provided as other configurations as long as it regulates power. As shown in FIG. 1, if the switch 40 is turned on, power supplied from the power supply 10 may be applied to the light emitting elements 50. However, if the switch 40 is turned off, power supplied from the power supply 10 may be cut off and then the current flows to diode D1.

If the current is supplied from the power supply 10 is turned on, the amount of the current applied to the light emitting elements 50 is increased. However, if power supplied from the power supply 10 is cut off, the amount of the current applied to the light emitting elements 50 is decreased.

In the foregoing exemplary embodiments of the present invention, the current applied to the LED is detected from an amount of output voltage Vout applied to the resistor R1. Alternatively, the current applied to the LED may be detected in various ways as long as the amount of the current applied to the LED is detected.

Figure 2:
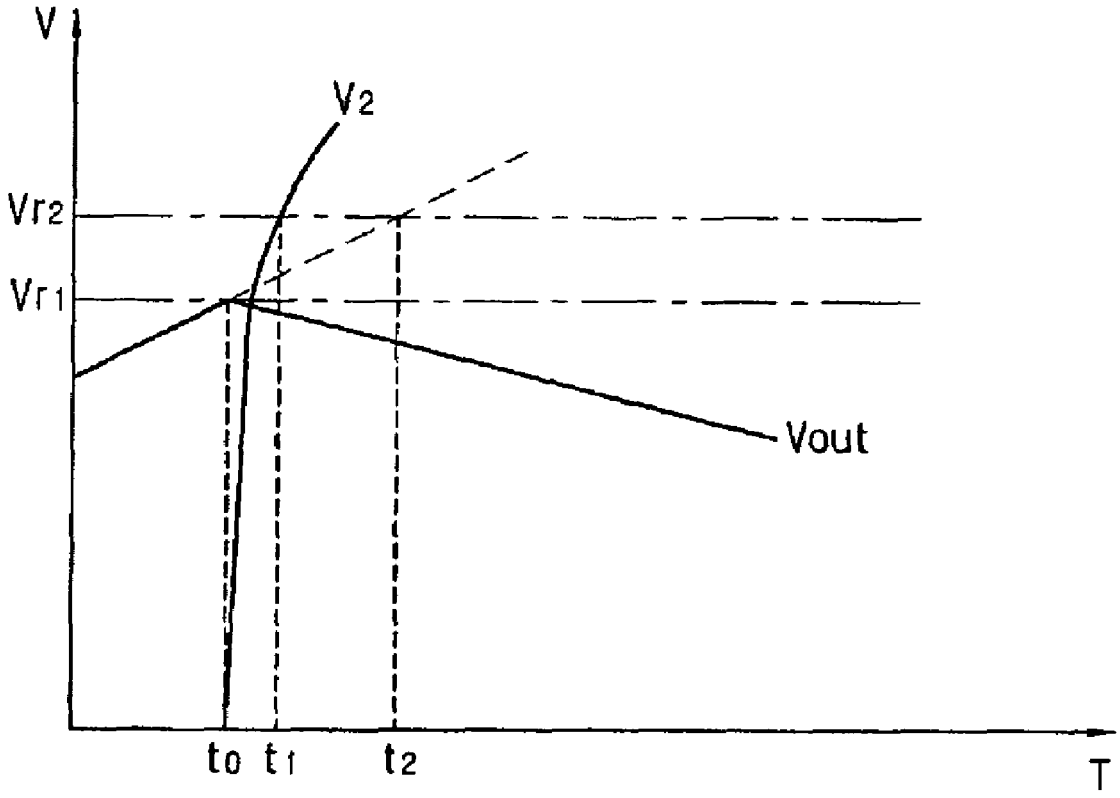
FIG. 2 is a graph of an output voltage and a comparison voltage according to the exemplary embodiment of the present invention.

As shown in FIG. 2, in the display apparatus, according to exemplary embodiments of the present invention, the output voltage Vout, which is proportional to the current applied to the light emitting elements 50, is increased while the switch 40 is turned on and decreased while the switch 40 is turned off. Preferably, the switch 40 is turned off at a point where the output voltage Vout becomes larger than the first reference voltage Vr1 applied to the comparing unit 20 in order to decrease the output voltage Vout.

If the reference voltage Vr2 applied to the comparator 31 in the conventional PWM generator is changed, the point where the switch 40 is turned off is drastically changed as a gradient of the output voltage Vout is gradual. For example, in the conventional display apparatus, if the reference voltage applied from the outside is Vr1 and the reference voltage recognized by the PWM generator is Vr2 by the predetermined process, such as providing the gain from a gain/offset controller 33, the switch 40 is turned off at point t2 and the current applied to the light emitting elements 50 starts to decrease at point t2. Thus, the current having a peak value higher than a desired value is outputted.

Meanwhile, the display apparatus according to the present invention compares an unprocessed first comparison voltage Vr1 to the output voltage Vout, thereby generating the comparison voltage V2 as shown in FIG. 2.

Since a response time of the comparison voltage V2 is short, the switch 40 is turned off at point t1, even if the second reference voltage Vr2 is applied to the comparator 31 in the PWM generator. Then, the current applied to the light emitting elements 50 at the point t1 is decreased, and the amount of current is decreased in the display apparatus. However, the conventional display apparatus is switched off at point t2. As described above, the display apparatus, according to exemplary embodiments of the present invention decreases errors in a point of time where the switch 40 is turned off.

Figure 3:
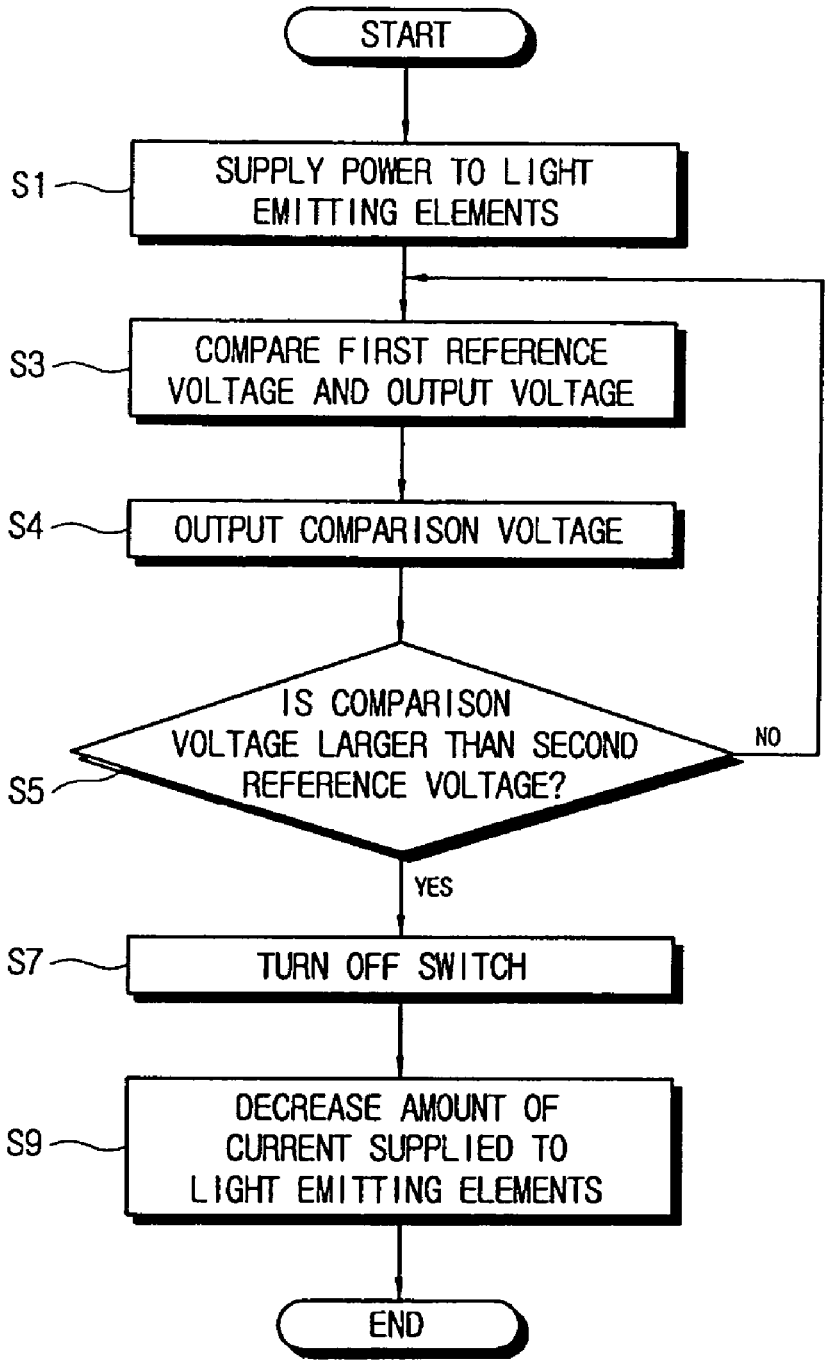
FIG. 3 is a control flowchart of the display apparatus according to the exemplary embodiment of the present invention.
Figure 4:
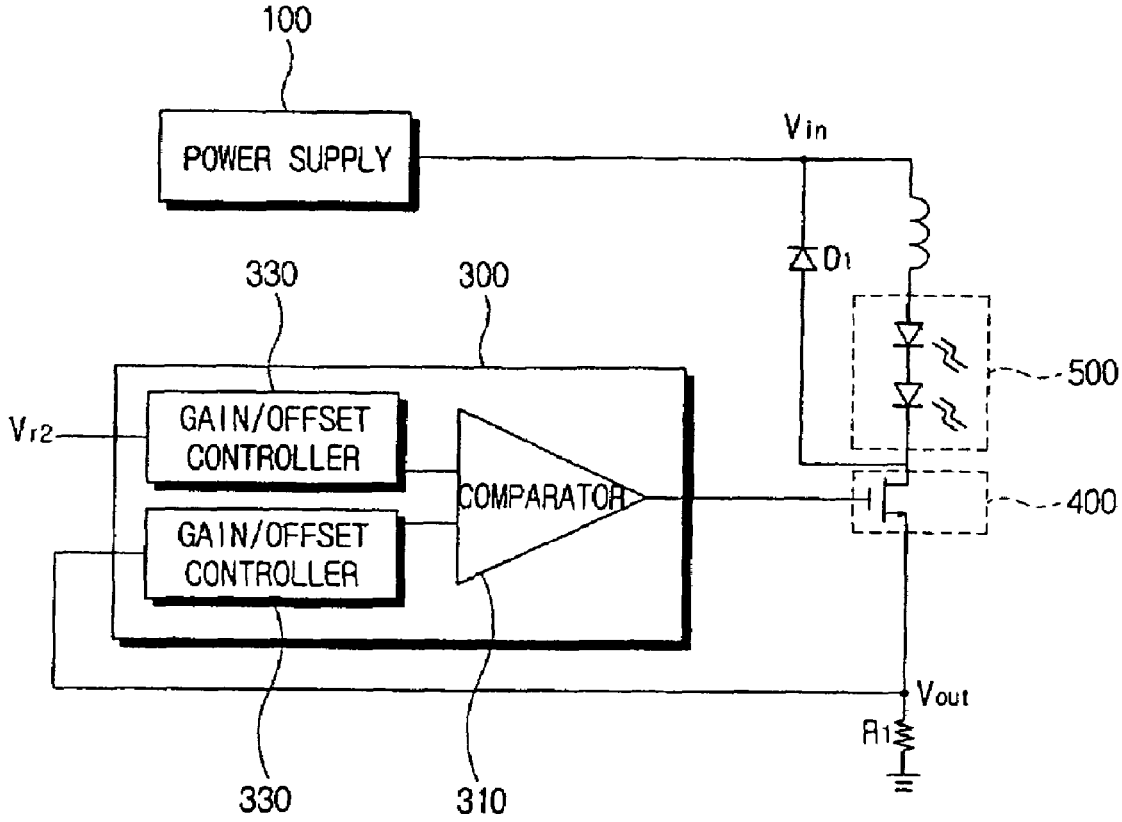
FIG. 4 (PRIOR ART)
FIG. 4 is a control block diagram of a conventional display apparatus.

As shown in FIG. 3, the display apparatus, according to exemplary embodiments of the present invention, controls the amount of the current supplied to the light emitting elements 50.

Specifically, if the current is supplied to the light emitting elements 50 at operation S1, the controller 30 switches on and off the switch 40 to control the amount of current supplied to the light emitting elements 50. The comparing unit 20 compares the output voltage Vout to the first reference voltage Vr1 in order to determine whether the current applied to the light emitting elements 50 is larger than the predetermined value at operation S3. If the comparison voltage V2 is applied to the controller 30 according to the comparison result at operation S4, the controller 30 compares the predetermined second reference voltage Vr2 to the comparison voltage V2 at operation S5. If the second reference voltage Vr2 is larger than the comparison voltage V2, the controller 30 controls the switch 40 to maintain an "on" state. If the predetermined second reference voltage Vr2 is smaller than the comparison voltage V2, the controller 30 turns off the switch 40 at operation S7. As a result, if the switch 40 is turned off, the current supplied from the power supply 10 to the light emitting elements 50 is cut off, thereby decreasing the amount of current supplied to the light emitting elements at operation S9.

In the foregoing exemplary embodiments of the present invention, one comparator is provided in the PWM generator. Alternatively, various PWM generators may be provided as long as the various PWM generators outputs a PWM signal.

The circuit of the switch described above is provided as a circuit of an unshielded buck converter, but not limited thereto. Alternatively, various circuits of the switch may be provided as long as the various circuits are a switch type.

In the display apparatus according to exemplary embodiments of the present invention, if a plurality of light emitting elements 50 are provided, the respective light emitting elements 50 may comprise different amounts of current according to respective conditions and characteristics. For example, if the LEDs in the light emitting elements 50 of the display apparatus are RLED, GLED and BLED, and the luminance of the respective LEDs is adjusted, the conventional display apparatus could not control luminance of the respective LEDs precisely. As a result, the LEDs uniformity is lowered. Meanwhile, the display apparatus according to the present invention controls luminance of the respective LEDs precisely, thereby improving the LEDs uniformity.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A display apparatus comprising a light emitting element supplying light, comprising:

a switch for switching on and off power which is supplied to the light emitting element;

a comparing unit for comparing a predetermined first reference voltage to an output voltage, which is proportional to current applied to the light emitting element; and a controller for comparing an output comparison voltage from a comparison result of the comparing unit to a predetermined second reference voltage, so as to control the switch to switch on and off.

2. The display apparatus according to claim 1, wherein the controller comprises a pulse width modulation (PWM) generator for generating a PWM signal to control the switch.

3. The display apparatus according to claim 1, wherein the controller compares the comparison voltage output from the comparison result of the comparing unit to the predetermined second reference voltage, and turns off the switch if the comparison voltage is larger than the predetermined second reference voltage.

4. The display apparatus according to claim 1, wherein the light emitting element is supplied to power by a switching method in which the current supplied to the light emitting element increases when the switch is turned on and the current supplied to the light emitting element decreases when the switch is turned off.

5. A method of controlling a display apparatus having a light emitting element supplying light, the method comprising:

comparing a predetermined first reference voltage to an output voltage, which is proportional to a current applied to the light emitting element;

outputting a comparison voltage according to a comparison result;

comparing the comparison voltage to a predetermined second reference voltage; and switching on and off power supplied to the light emitting element according to the comparison result.

6. The method according to claim 5, wherein the comparing of the comparison voltage to the predetermined second reference voltage comprises outputting a PWM signal to control a switch to be turned on and off according to the comparison result.

7. The method according to claim 5, wherein the switching comprises cutting off power supplied to the light emitting element if the comparison voltage is larger than the second reference voltage.

8. The method according to claim 5, wherein the switching comprises increasing the current supplied to the light emitting element if power is supplied, and decreasing the current supplied to the light emitting element if power is cut off.

* * * * *

UNITED STATES PATENT AND TRADEMARK OFFICE

CERTIFICATE OF CORRECTION

PATENT NO. : 7,626,340 B2
APPLICATION NO. : 11/442389
DATED : December 1, 2009
INVENTOR(S) : Kang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 462 days.

Signed and Sealed this

Second Day of November, 2010

David J. Kappos

David J. Kappos
*Director of the United States Patent and Trademark Office*